US010319287B2

(12) United States Patent
Richter et al.

(10) Patent No.: US 10,319,287 B2
(45) Date of Patent: Jun. 11, 2019

(54) METHOD FOR OPERATING BI-DIRECTIONAL DISPLAY

(71) Applicant: Fraunhofer-Gesellschaft zur Förderung der angewandten Forschung e.V., Munich (DE)

(72) Inventors: Bernd Richter, Dresden (DE); Phillipp Wartenberg, Dresden (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

(21) Appl. No.: 15/512,512

(22) PCT Filed: Sep. 15, 2015

(86) PCT No.: PCT/EP2015/071116
§ 371 (c)(1),
(2) Date: Mar. 17, 2017

(87) PCT Pub. No.: WO2016/041978
PCT Pub. Date: Mar. 24, 2016

(65) Prior Publication Data

US 2017/0294158 A1 Oct. 12, 2017

(30) Foreign Application Priority Data

Sep. 19, 2014 (DE) ..... 10 2014 113 577

(51) Int. Cl.
*G09G 3/22* (2006.01)
*G09G 3/20* (2006.01)

(52) U.S. Cl.
CPC ..... *G09G 3/22* (2013.01); *G09G 3/20* (2013.01); *G09G 2310/08* (2013.01);
(Continued)

(58) Field of Classification Search
CPC . G09G 3/22; G09G 2310/08; G09G 2360/147
See application file for complete search history.

(56) References Cited

U.S. PATENT DOCUMENTS 7,095,787 B2 8/2006 Gonzalez-Banos et al.
2005/0162638 A1 7/2005 Suzuki et al.
(Continued)

FOREIGN PATENT DOCUMENTS

DE 10 2006 030 541 A1 12/2007
WO WO 2012/163312 A1 6/2012
WO WO 2013/157001 A1 10/2013

OTHER PUBLICATIONS

Bernd Richter et al., "Bidirectional OLED Microdisplay: Combining Display and Image Sensor Functionality into a Monolithic CMOS Chip," May 2011, pp. 314-316, International Solid-State Circuits Conference Digest of Technical Papers, 2011 IEEE, ISSCC 2011, Biomedical and Displays-17.8.
(Continued)

*Primary Examiner* — Kwang-Su Yang
(74) *Attorney, Agent, or Firm* — Brinks Gilson & Lione

(57) ABSTRACT

A method for operating a bidirectional display comprising a substrate, on which a display array consisting of a multiplicity of light-generating image elements and a sensor array consisting of a multiplicity of light-detecting elements are formed, each light-detecting element being assigned at least one light-generating image element, and each light-detecting element having at least a photodetector, a reset switch, a transfer switch, a memory and a select switch. The exposure phase of a light-detecting element between two successive readout phases of the light-detecting element is in this case subdivided into at least two exposure subphases chronologically separated from one another, and the at least one light-generating image element assigned to the light-detect-
(Continued)

ing element is activated at least temporarily between the two exposure subphases of the light-detecting element.

8 Claims, 4 Drawing Sheets

(52) U.S. Cl.
CPC ..... *G09G 2354/00* (2013.01); *G09G 2360/14* (2013.01); *G09G 2360/147* (2013.01)

(56) References Cited

U.S. PATENT DOCUMENTS

| | | | | |
|---|---|---|---|---|
| 2010/0012817 | A1 | 1/2010 | Vogel et al. | |
| 2014/0145939 | A1 | 5/2014 | Herold et al. | |
| 2014/0166850 | A1 | 6/2014 | Zheng | |
| 2014/0203170 | A1* | 7/2014 | Ono | G02B 26/02 250/208.1 |
| 2015/0092084 | A1* | 4/2015 | Lee | H04N 5/2256 348/234 |
| 2016/0344965 | A1* | 11/2016 | Grauer | H04N 5/353 |

OTHER PUBLICATIONS

International Search Report, dated Nov. 24, 2015, pp. 1-4, issued in International Patent Application No. PCT/EP2015/071116, European Patent Office.

Bernd Richter et al., "OLED-on-CMOS based bidirectional microdisplay for near-to-eye and sensor applications," 2011, pp. 1-3, Center for Organic Materials and Electronic Devices Dresden, Dresden, Germany.

* cited by examiner

METHOD FOR OPERATING BI-DIRECTIONAL DISPLAY

CROSS-REFERENCE TO RELATED APPLICATIONS

This application is a 371 nationalization of PCT/EP2015/071116 having an international filing date of Sep. 15, 2015, the entire contents of which are hereby incorporated by reference, which in turn claims priority under 35 USC § 119 to German patent application 10 2014 113 577.6 filed on Sep. 19, 2014, the contents of both are hereby incorporated by reference.

TECHNICAL FIELD

The invention relates to a method for operating a bidirectional display, on which both an array of light-generating image elements and an array of light-detecting elements are arranged. The light-detecting elements of a bidirectional component are also referred to as active pixel sensors (abbreviated to APS) or as a pixel cell. In particular, the invention relates to a method for driving APSs.

BACKGROUND

Besides CCDs (charge-coupled devices), image sensing devices based on CMOS technology constitute a widespread variant of image sensors. Sensors based on CMOS technology have the advantage over CCDs that electronic circuits can be co-integrated very simply on a chip, which makes complex system-on-chip solutions possible.

DE 10 2006 030 541 A1 describes an arrangement in which electromagnetic radiation-emitting elements and electromagnetic radiation-detecting elements are located together on a chip. In this case, the two element types may be arranged in a matrix on the chip. A disadvantagous effect of this is that the immediately adjacent arrangement of electromagnetic radiation-emitting elements and electromagnetic radiation-detecting elements leads to cross-coupling.

WO 2012/163312 A1 discloses bidirectional displays on which a plurality of light-generating image elements and a plurality of light-detecting elements are arranged in the form of an array. In this case, the light-generating image elements as a whole may, for example, function as a display surface of a display and the light-detecting elements as a whole may, for example, function as a sensor of a camera. WO 2012/163312 A1 furthermore describes different driving variants for the elements, which are intended to solve the problem of direct crosstalk from light-generating image elements to adjacent light-detecting elements by driving the light-generating image elements and adjacent light-detecting elements successively. Light-generating image elements and adjacent light-detecting elements are therefore actively effective only alternately in succession.

When a light-detecting element is activated, a single full exposure phase is always followed by a readout phase of this light-detecting element. All the light-detecting elements are driven in the same way. In relation to the light-detecting elements as a whole, and therefore the function as a camera, only the functionality of the shutter of the camera is varied. Driving for both a global shutter and for a rolling shutter is described.

When the light-generating image elements of a bidirectional device function as a display, the driving variants disclosed in WO 2012/163312 A1 reach their limitations. In particular, the inactivity of the light-generating image elements during an exposure time of light-detecting elements, which requires a particular length for a good signal quality, may lead to perceptible image perturbations, or at least to a visible brightness loss. The sensitivity of the detector elements in turn cannot be increased arbitrarily since ever-higher resolutions are required in display applications, while the chip area used should remain as small as possible for cost reasons, so that the space for detector elements or circuit-technology measures to increase the sensitivity thereof are thus greatly restricted.

DETAILED DESCRIPTION

Figure 1:
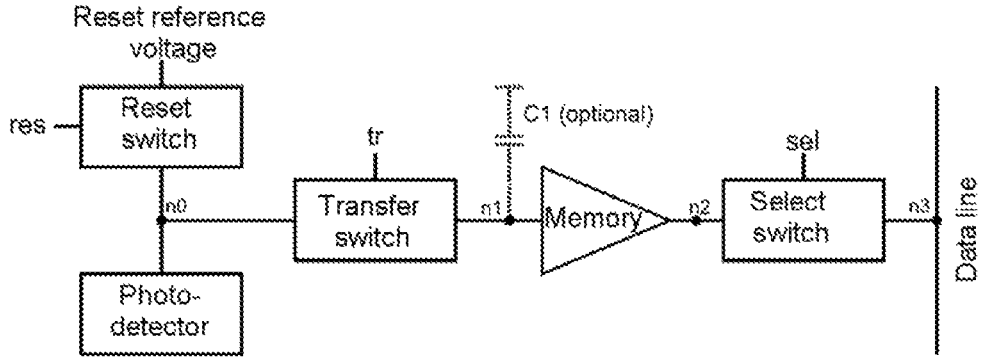
FIG. 1 shows a schematic representation of a structure of a light-emitting element.

The technical object of the invention is therefore to provide a method for driving a bidirectional display, by means of which the disadvantages from the prior art can be overcome. In particular, light-generating image elements and light-detecting elements are intended to be driven with the method according to the invention in such a way that a mutual influence is at least reduced, and the performance perceptible to the human eye should as far as possible not be reduced.

In the method according to the invention, a bidirectional display comprising a substrate, on which a two-dimensional display array consisting of a multiplicity of light-generating image elements and a two-dimensional sensor array consisting of a multiplicity of light-detecting elements are formed, each light-detecting element being assigned at least one light-generating image element, is operated in such a way that the exposure phase of a light-detecting element between two successive readout phases of the light-detecting element is subdivided into at least two exposure subphases chronologically separated from one another, and the at least one light-generating image element assigned to the light-detecting element is activated at least temporarily between the two exposure subphases of the light-detecting element. Preferably, the exposure phase of the light-detecting element is subdivided into more than just two exposure subphases, and the light-generating image element is respectively activated at least temporarily between two successive exposure subphases. The method according to the invention therefore offers the advantage that the inactive time of a light-generating image element extends no longer continuously over the entire duration of a full exposure phase of a light-detecting element, but now only over fractions of an exposure phase. The activation of a light-generating image element at shorter time intervals compared with the prior art leads to an improved image quality. Furthermore, the exposure subphases of a light-detecting element and emit phases of a light-generating image element are also carried out in succession in the method according to the invention, so that cross-coupling of light-generating and light-detecting elements is prevented. The term emit phases is in this case intended to mean the active phases of a light-generating image element, i.e. those phases during which the light-generating element emits light.

In the subdivision of the exposure phase into exposure subphases according to the invention, the exposure subphases are preferably selected to be of equal length, although as an alternative they may also be set with a different length. Likewise, the time intervals between successive exposure subphases may be set to have the same length or, alternatively, different lengths.

The present invention will be explained in more detail below with the aid of exemplary embodiments Bidirectional displays for which the method may be used are, for example, described in WO 2012/163312 A1.

Such a bidirectional display comprises both a multiplicity of light-generating image elements and a multiplicity of light-detecting elements, which are conventionally interleaved with one another in the manner of an array having a number of rows and columns.

Figure 2:
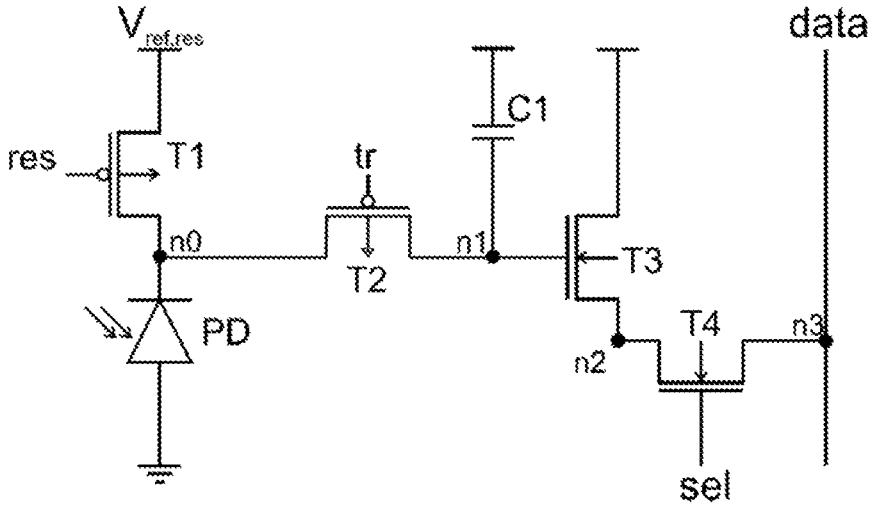
FIG. 2 shows an equivalent circuit diagram of a light-emitting element.

FIG. 1 schematically represents the structure of a light-detecting element, and FIG. 2 represents it as an equivalent circuit diagram. Such a light-detecting element comprises at least the following components: a photodetector PD, a reset switch T1, a transfer switch T2, a memory T3 and a select switch T4, which are electrically interconnected with one another via the nodes n0, n1, n2 and n3. Optionally, a capacitor element C1 may also be interconnected with node n1.

Figure 3:
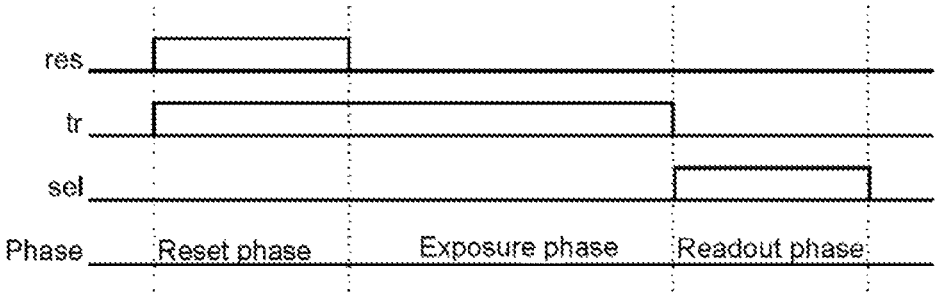
Prior Art Fig. 3
FIG. 3 shows a schematic representation of a phase sequence for driving a light-emitting element according to the prior art.

FIG. 3 schematically shows a phase sequence with which a light-detecting element of a bidirectional display according to the prior art is driven. In this case, the reset switch T1 is driven with the signal "res", the transfer switch T2 with the signal "tr" and the select switch T4 with the signal "sel". For all subsequently described control signals of the switches, for reasons of clarity, highly active signals are assumed, i.e. the switches are closed—i.e. connected—when a signal reaches the state high or "1", and opened—i.e. disconnected—when the control signal reaches the level low or "0". As is known from circuit technology, a switch may however alternatively also be closed with a low signal and opened with a high signal.

At an initial instant, according to the prior art as per FIG. 3, a reset phase is started by closing the reset switch T1 and the transfer switch T2 by a respective high signal at the signal inputs "res" and "tr", while the select switch T4 is open. As a result of this, the reset reference voltage "$V_{ref,\ res}$" is connected through to the nodes n0 and n1. With the opening of the reset switch T1 because of a low signal at the signal input "res", the reset phase ends and at the same time an exposure phase starts. Owing to the electrical current flowing through the photodetector PD, the electrical voltage at the nodes n0 and n1 is reduced until the transfer switch T2 is opened by means of a low signal at the signal input "tr" and a full exposure phase is thereby ended. A corresponding voltage value is now stored in the memory T3 and is read out via a data line "data" during a readout phase by the select switch T4 being closed by means of a high signal at the signal input "sel". After opening of the select switch by means of a low signal at the signal input "sel", the entire cycle begins again with a further reset phase at a new initial instant. According to the prior art, light-generating image elements assigned to the light-detecting element remain inactive throughout an entire exposure phase of the light-detecting element.

According to the invention, a full exposure phase of a light-detecting element is subdivided into a plurality of chronologically separated exposure subphases, and furthermore light-generating image elements assigned to the light-detecting element are at least temporarily activated between the exposure subphases. The image elements assigned to a light-detecting element are necessarily light-generating image elements that are adjacent to the light-detecting element, although it is necessary to prevent cross-coupling especially of neighbouring elements of the two element types. As a minimum, a light-detecting element is also assigned only one light-generating image element. In another embodiment, there may also be a plurality of light-detecting elements to which one and the same light-generating image element is assigned.

Figure 4:
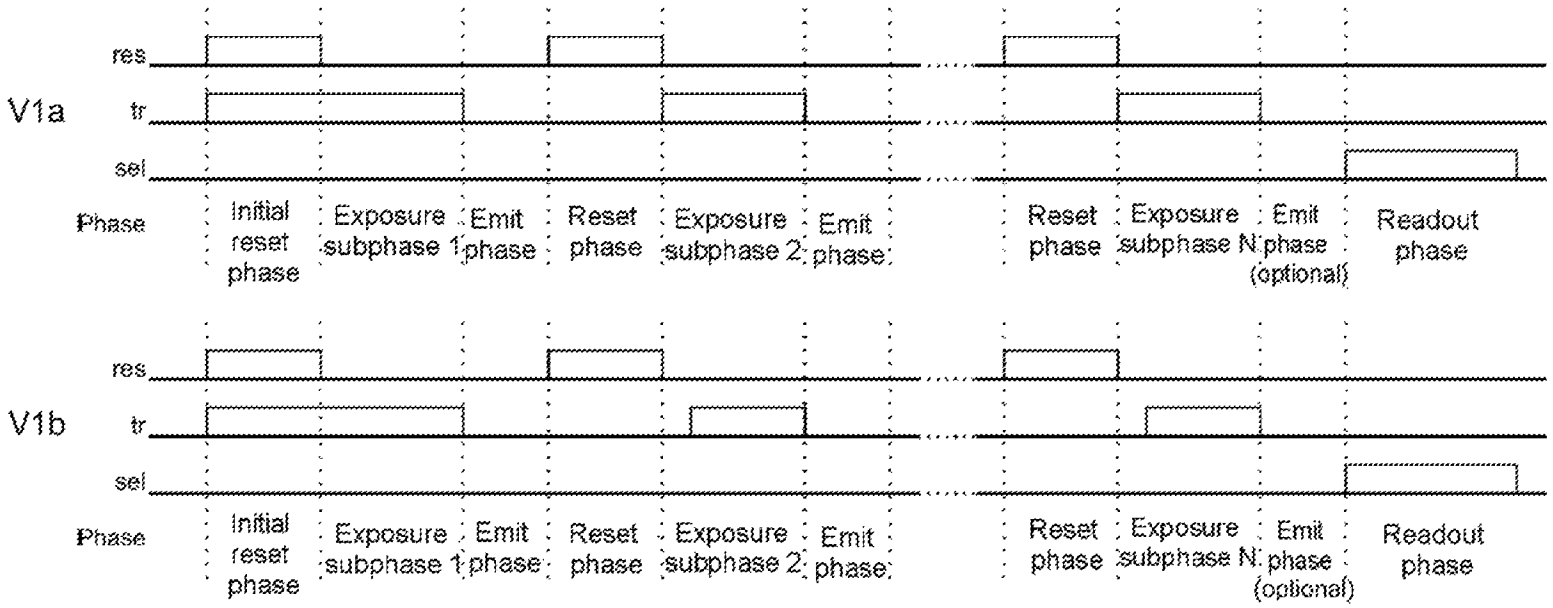
FIG. 4 shows a schematic representation of a phase sequence for the inventive operation of a light-detecting element and associated light-generating image elements in two variants.
Figure 5:
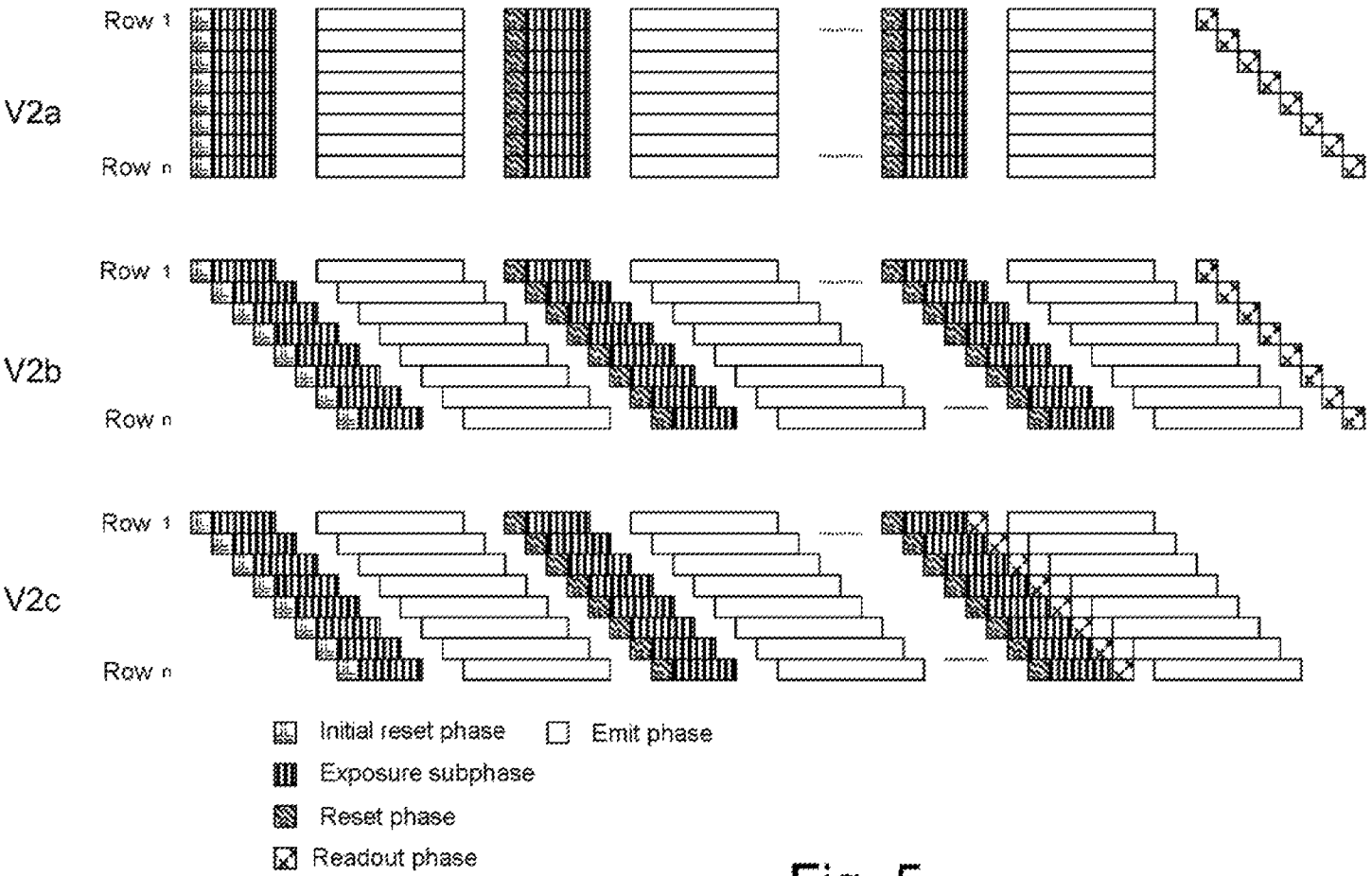
FIG. 5 shows a schematic representation of a phase sequence of a multiplicity of light-detecting elements arranged in rows, in variants.

FIG. 4 shows a schematic representation of a phase sequence for the inventive operation of a light-detecting element as represented by way of example in FIGS. 1 and 2, and light-generating image elements assigned to the light-detecting element, on a bidirectional display. For such a phase sequence, FIG. 4 represents two variants, a variant V1*a* and a variant V1*b*. In this case as well, the reset switch T1 is driven with the signal "res", the transfer switch T2 with the signal "tr" and the select switch T4 with the signal "sel".

In variant V1*a*, at an initial instant, an initial reset phase beginning with a repeating cycle is started by closing the reset switch T1 and the transfer switch T2 by a respective high signal at the signal inputs "res" and "tr", while the select switch T4 is open. As a result of this, the reset reference voltage "$V_{ref,\ res}$" is connected through to the nodes n0 and n1. With the opening of the reset switch T1, this reset phase ends and at the same time an exposure subphase 1, which lasts only a fraction of a full exposure phase, starts. The exposure subphase 1 is ended by opening the transfer switch T2. This is immediately followed by an emit phase, in which the image elements assigned to the light-detecting element emit light. With closure of the reset switch T1, a further reset phase starts. Since the transfer switch T2 in this case remains open, only the node n0 is reset to the reset reference voltage "$V_{ref,\ res}$". The reset phase is ended with opening of the reset switch T1, and at the same time an exposure subphase 2 is started with closure of the transfer switch T2. Because the reset T1 is now open and the transfer switch T2 is closed, charge equilibration takes place between the node n0 (the node of the photodetector PD) and the node n1 (memory node of the last exposure subphase). At the same time, the photodetector PD causes a charge modification at the now short-circuited nodes n0 and n1. The exposure subphase 2 ends with opening of the transfer switch, and is again followed by an emit phase during which the light-generating image elements assigned to the light-detecting element emit light. The sequence of reset phase, exposure subphase and emit phase is subsequently continued until an exposure subphase N, with which a desired signal level for the exposure is finally reached and a full exposure phase is therefore ended. The exposure phase N may optionally also be followed by another emit phase, or alternatively a readout phase starts immediately after the exposure subphase N with closure of the select switch T4. The readout phase, in which the value stored in the memory T3 is read out via the data line "data", ends with opening of the select switch T4. Following this, a new exposure cycle starts with an initial reset phase.

Variant V1*b* differs from variant V1*a* only in that a pause is inserted between an exposure subphase and a proceeding reset phase in variant V1*b*, starting with the exposure subphase 2. In this way, it is possible to prevent cross-coupling of the reset phase to the exposure phase, which could lead to the stored value being influenced by preceding exposure sections. In the schematically represented phase sequences according to FIG. 4, there is an emit phase, in which light-generating image elements are activated, primarily between an exposure subphase and a reset phase. It should be explicitly mentioned here that the protective scope of the invention is not limited to the light-generating image elements having to be activated for the emission of light immediately with the end of an exposure subphase and therefore following the start of an emit phase. The activation of the light-generating image elements may also take place during an emit phase with a pause from the preceding exposure subphase. Likewise, the protective scope of the invention includes embodiments in which the activation of light-generating image elements extends beyond a schematically represented emit phase into a subsequent reset phase. What is essential for avoiding cross-coupling is merely that the activation of light-generating image elements does not coincide with an exposure subphase of an associated light-detecting element.

The inventive operation of a bidirectional display has been described above merely with reference to one light-detecting element and associated light-generating image elements. However, a bidirectional display often consists of a multiplicity of light-detecting elements and a multiplicity of light-generating image elements, which are arranged on the bidirectional display preferably while being interleaved with one another in a number of rows and columns of an array. As an alternative, the display array and the sensor array may also be arranged next to one another. According to the invention, each of the light-detecting elements and the image elements respectively assigned to these elements are driven according to the phase sequence described above. The readout of the individual pixel cells is in this case carried out by addressing them, for example, according to known method steps via a row line and forwarding the value of the desired pixel cell to external signal processing via a column line.

FIG. 6 shows a schematic representation of three variants of phase sequences for the inventive driving of a bidirectional display, in which a multiplicity of light-detecting elements and light-generating image elements are arranged in the form of a pixel matrix. In variant V2*a*, the individual phases of light-detecting elements of all rows are carried out simultaneously. Only the readout phases of the rows are carried out successively with a time offset. If all the light-detecting elements of a bidirectional display as a whole are considered as a sensor of a camera, the phase sequence of the pixel rows as represented in variant V2*a* corresponds to a so-called global shutter. The phase sequences represented in variants V2*b* and V2*c*, with a time offset from row to row, on the other hand correspond to the principle of a so-called rolling shutter. Variants V2*b* and V2*c* differ only in that an emit phase is again carried out after a final exposure subphase before the readout phase in a row begins in variant V2*b*. In variant V2*c*, conversely, the readout takes place immediately after the final exposure subphase.

The invention claimed is:

1. A method for operating a bidirectional display comprising a substrate, on which a display array comprising a plurality of light-generating image elements and a sensor array comprising a plurality of light-detecting elements are formed, each light-detecting element being assigned at least one of the light-generating image elements, and each light-detecting element including at least a photodetector, a reset switch, a transfer switch, a memory, and a select switch, the method comprising:

subdividing an exposure phase of a light-detecting element between two successive readout phases of the light-detecting element into at least two exposure subphases chronologically separated from one another;

activating, at least temporarily between the two exposure subphases of the light-detecting element, the at least one of the light-generating image elements assigned to the light-detecting element; and carrying out, after an initial instant at which the reset switch and the transfer switch are closed and the select switch is opened, the following phases:

a) a reset phase, which ends with a first opening of the reset switch;

b) an exposure subphase, which starts with the first opening of the reset switch and ends with a first opening of the transfer switch;

c) an emit phase, in which the at least one of the light-generating elements is activated;

d) a reset phase, which starts with a first closure of the reset switch and ends with a second opening of the reset switch;

e) an exposure subphase, which starts with a first closure of the transfer switch and ends with a second opening of the transfer switch;

f) an emit phase, in which the at least one of the light-generating elements is activated; and g) a readout phase, which starts with a closure of the select switch and ends with an opening of the select switch.

2. The method according to claim 1, wherein the exposure subphases have the same length or different lengths.

3. The method according to claim 1 further comprising carrying out phases d) to f) repeatedly before phase g).

4. The method according to claim 1 further comprising carrying out phases d) and e) successively without a pause.

5. The method according to claim 1 further comprising inserting a pause between phases d) and e).

6. The method according to claim 1 further comprising driving the light-detecting elements according to the global shutter principle, wherein the light-detecting elements are arranged in rows and columns on the bidirectional display.

7. The method according to claim 1 further comprising driving the light-detecting elements according to the rolling shutter principle, wherein the light-detecting elements are arranged in rows and columns on the bidirectional display.

8. The method according to claim 1, wherein the light-generating image elements and the light-detecting elements are interleaved with one another or next to one another on the substrate.

* * * * *